US012540448B2

(12) United States Patent
Lamontagne

(10) Patent No.: US 12,540,448 B2
(45) Date of Patent: Feb. 3, 2026

(54) REMOVABLE SHORING ELEMENT

(71) Applicant: Richlyn Developments Ltd., Edmonton (CA)

(72) Inventor: Richard Lamontagne, Edmonton (CA)

(73) Assignee: RICHLYN DEVELOPMENTS LTD., Edmonton (CA)

( * ) Notice: Subject to any disclaimer, the term of this patent is extended or adjusted under 35 U.S.C. 154(b) by 152 days.

(21) Appl. No.: 18/406,892

(22) Filed: Jan. 8, 2024

(65) Prior Publication Data

US 2024/0279894 A1 Aug. 22, 2024

(30) Foreign Application Priority Data

Feb. 16, 2023 (CA) ..... 3190096

(51) Int. Cl.

| | |
|---|---|
| ***E02D 11/00*** | (2006.01) |
| ***E02D 9/02*** | (2006.01) |
| ***E02D 17/04*** | (2006.01) |
| ***E02D 29/02*** | (2006.01) |

(52) U.S. Cl.

CPC ..... *E02D 11/00* (2013.01); *E02D 9/02* (2013.01); *E02D 17/04* (2013.01); *E02D 29/02* (2013.01)

(58) Field of Classification Search

CPC ..... E02D 11/00; E02D 9/02; E02D 17/04; E02D 29/02

See application file for complete search history.

(56) References Cited

U.S. PATENT DOCUMENTS

| | | | | |
|---|---|---|---|---|
| 4,858,876 | A | 8/1989 | Moreno | |
| 5,570,975 | A * | 11/1996 | Reinert, Sr. | E02D 7/26 173/184 |
| 5,899,030 | A * | 5/1999 | Barefield | E04H 12/2215 403/374.1 |
| 8,230,648 | B2 | 7/2012 | Bulloch | |
| 9,903,087 | B2 * | 2/2018 | Foster | E02D 29/02 |
| 2005/0232707 | A1 | 10/2005 | Reinert, Sr. | |
| 2008/0302028 | A1 | 12/2008 | Lewenhoff | |
| 2009/0211178 | A1 | 8/2009 | Marshall | |

FOREIGN PATENT DOCUMENTS

| | | | |
|---|---|---|---|
| AU | 2018202189 | A1 | 5/2018 |
| AU | 2018101072 | A4 | 9/2018 |
| CA | 2193948 | C | 1/1996 |
| CA | 2885091 | C | 3/2014 |
| DE | 10113756 | A1 | 9/2002 |
| FR | 2863633 | A1 | 6/2005 |
| GB | 2420581 | B | 5/2006 |
| WO | 9914441 | A1 | 3/1999 |
| WO | 2013067584 | A1 | 5/2013 |
| WO | 2022076944 | A1 | 4/2022 |

* cited by examiner

*Primary Examiner* — Carib A Oquendo

(74) *Attorney, Agent, or Firm* — Nathan V. Woodruff

(57) ABSTRACT

A shoring element has a shoring plate and a shaft received within a shaft receiver of the shoring plate. The shoring plate is rotatable and is permitted limited axial movement along the shaft. During installation, rotating the shaft in a first direction drives the shaft into the ground formation and causes the drive collar to contact a drive shoulder of the shoring plate such that the drive collar applies a driving force to the shoring plate. During removal, the shaft is rotated in a second direction to withdraw the shaft from the ground formation and the drive collar to move away from the drive shoulder. Applying an upward force to the lifting points causes the shoring plate to move axially relative to the shaft.

20 Claims, 6 Drawing Sheets

REMOVABLE SHORING ELEMENT

TECHNICAL FIELD

This relates to shoring elements, and in particular, shoring elements that are moveable relative to the shaft on which they are carried.

BACKGROUND

Shoring plates are used in construction projects to support a ground formation and prevent cave-ins. Shoring plates may be used for home or building construction, bridges, tunnels, etc. U.S. Pat. No. 9,903,087 (Foster et al.) entitled "Ground engaging shaft" is an example of a shoring plate that is driven into the ground using a shaft with an auger on the bottom end.

SUMMARY

According to an aspect, there is provided a shoring element. The shoring element comprises a shaft having a top end, a bottom end, and an axis. The shaft comprises a rotary drive connector at the top end of the shaft, an auger at the bottom end of the shaft, and a drive collar axially spaced between the top end and the bottom end. The shoring element further comprises a shoring plate. The shoring plate comprises a shaft receiver that receives the shaft such that the shoring plate is rotatably and axially moveable relative to the shaft, the drive collar and the shaft receiver cooperating to permit limited axial movement of the shoring plate along the shaft toward the top end of the shaft. The shoring plate further comprises a drive shoulder that is sized to engage the drive collar, the drive shoulder being positioned between the drive collar and the bottom end of the shaft, and lifting points. During installation, rotating the shaft in a first direction causes the auger to drive the shaft into a ground formation and the drive collar to contact the drive shoulder of the shoring plate such that the drive collar applies a driving force to the shoring plate. During removal, rotating the shaft in a second direction causes the auger to withdraw from the ground formation and the drive collar to move away from the drive shoulder, and applying an upward force to the lifting points causes the shoring plate to move toward the top end of the shaft.

According to other aspects, the shoring element may include one or more of the following features, alone or in combination: the shaft receiver may be a first tubular sleeve, and the drive shoulder may be a top surface of the first tubular sleeve; the shaft receiver may further comprise a second tubular sleeve spaced from the first tubular sleeve toward the top end of the shaft, a bottom surface of the second tubular sleeve comprising an upper limit shoulder, and the drive collar may be disposed between drive shoulder and the upper limit shoulder; the shoring plate may further comprise an upper limit shoulder that is positioned between the drive collar and the top end of the shaft such that the axial movement of the shoring plate along the shaft is limited by the drive shoulder and the upper limit shoulder; the shaft receiver may be a tubular sleeve, the drive shoulder may be a bottom surface of the tubular sleeve, and the upper limit shoulder may be a top surface of the tubular sleeve, and wherein the drive collar may comprise a first drive collar that is adapted to engage the drive shoulder and a second drive collar that is adapted to engage the upper limit shoulder, wherein a spacing between the first drive collar and the second drive collar defining the axial movement of the shoring plate along the shaft; the drive collar and the shaft receiver may permit at least 12 inches of axial movement of the shoring plate along the shaft; and the lifting points may comprise apertures formed in the shoring plate.

According to an aspect, there is provided a method of removing a shoring element, comprising: with the shoring element installed in a ground formation, the shoring element comprising a shaft and a shoring plate, the shaft comprising a rotary drive connector at a top end of the shaft, an auger at a bottom end of the shaft, and a drive collar spaced between the rotary drive connector and the auger that engages a drive shoulder of the shoring plate, the shaft being carried in a shaft receiver of the shoring plate that permits limited axial movement of the shaft relative to the shoring plate:

driving the rotary drive connector in a direction that causes the auger to withdraw from the ground formation such that the shaft moves axially relative to the shoring plate and the drive collar is spaced from the drive shoulder of the shoring plate; and with the shaft stationary, applying a lifting force to the shoring plate relative to the shaft such that the shoring plate moves axially relative to the shaft and the drive shoulder moves toward the drive collar.

According to another aspect, the method may further comprise one or more of the following steps, alone or in combination: wherein the steps of driving the rotary drive connector and applying a lifting force to the shoring plate may be alternatingly applied; the lifting force may be applied between the rotary drive connector and lifting points of the shoring plate; the shoring plate may further comprise an upper limit shoulder that is positioned between the drive collar and the top end of the shaft such that the axial movement of the shoring plate along the shaft is limited by the drive shoulder and the upper limit shoulder; and the drive collar and the shaft receiver may permit at least 12 inches of axial movement of the shoring plate along the shaft.

According to an aspect, there is provided a system for removing shoring plates from a ground formation, the system comprising a shoring element comprising a shaft and a shoring plate. The shaft has a top end, a bottom end, and an axis, the shaft comprising a rotary drive connector at the top end of the shaft, an auger at the bottom end of the shaft, and a drive collar axially spaced between the top end and the bottom end. The shoring plate comprises: a shaft receiver that receives the shaft such that the shoring plate is rotatably and axially moveable relative to the shaft, the drive collar and the shaft receiver cooperating to permit limited axial movement of the shoring plate along the shaft toward the top end of the shaft; a drive shoulder that is sized to engage the drive collar, the drive shoulder being positioned between the drive collar and the bottom end of the shaft; and lifting points. During installation, rotating the shaft in a first direction causes the auger to drive the shaft into the ground formation and the drive collar to contact the shoring plate at a first contact point and drive the shoring plate into the ground formation. During removal, rotating the shaft in a second direction causes the auger to withdraw from the ground formation and the drive collar to move away from the first contact point and applying an upward force to the lifting points causes the shoring plate to move toward the top end of the shaft. A driver comprises a rotary driver that is configured to apply a rotary force to the rotary drive connector; and linear actuators on opposed sides of the rotary driver that are configured to engage the lifting points of the shoring plate and apply a lifting force relative to the rotary driver, such that the lifting force is applied between the rotary drive connector and the lifting points.

According to an aspect, the system may comprise one or more of the following features, alone or in combination: the linear actuators may comprise hydraulic cylinders; the shaft receiver may be a first tubular sleeve, and the drive shoulder may be a top surface of the first tubular sleeve; the shaft receiver may further comprise a second tubular sleeve spaced from the first tubular sleeve toward the top end of the shaft, a bottom surface of the second tubular sleeve comprising an upper limit shoulder, and the drive collar being disposed between drive shoulder and the upper limit shoulder; the shaft receiver may comprise a first tubular sleeve having a top surface that comprises the drive shoulder and a second tubular sleeve spaced from the first tubular sleeve toward the top end of the shaft, the second tubular sleeve having a bottom surface that comprises an upper limit shoulder; the shoring plate may further comprise an upper limit shoulder that is positioned between the drive collar and the top end of the shaft such that the axial movement of the shoring plate along the shaft is limited by the drive shoulder and the upper limit shoulder; the drive collar and the shaft receiver may permit at least 12 inches of axial movement of the shoring plate along the shaft.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purposes of illustration only and are not intended to be in any way limiting, wherein.

DETAILED DESCRIPTION OF PREFERRED EMBODIMENTS

A shoring element, generally identified by reference number 10, will now be described with reference to FIG. 1 through 6. Shoring element 10 may be installed as a temporary shoring element for a ground formation. Multiple shoring elements 10 may be installed in a row to form a barrier or retaining wall of extended length, and adjacent shoring elements may interlock. For example, shoring elements 10 may be used as a temporary or permanent retaining wall, to support the sides of an excavation, etc.

Figure 1:
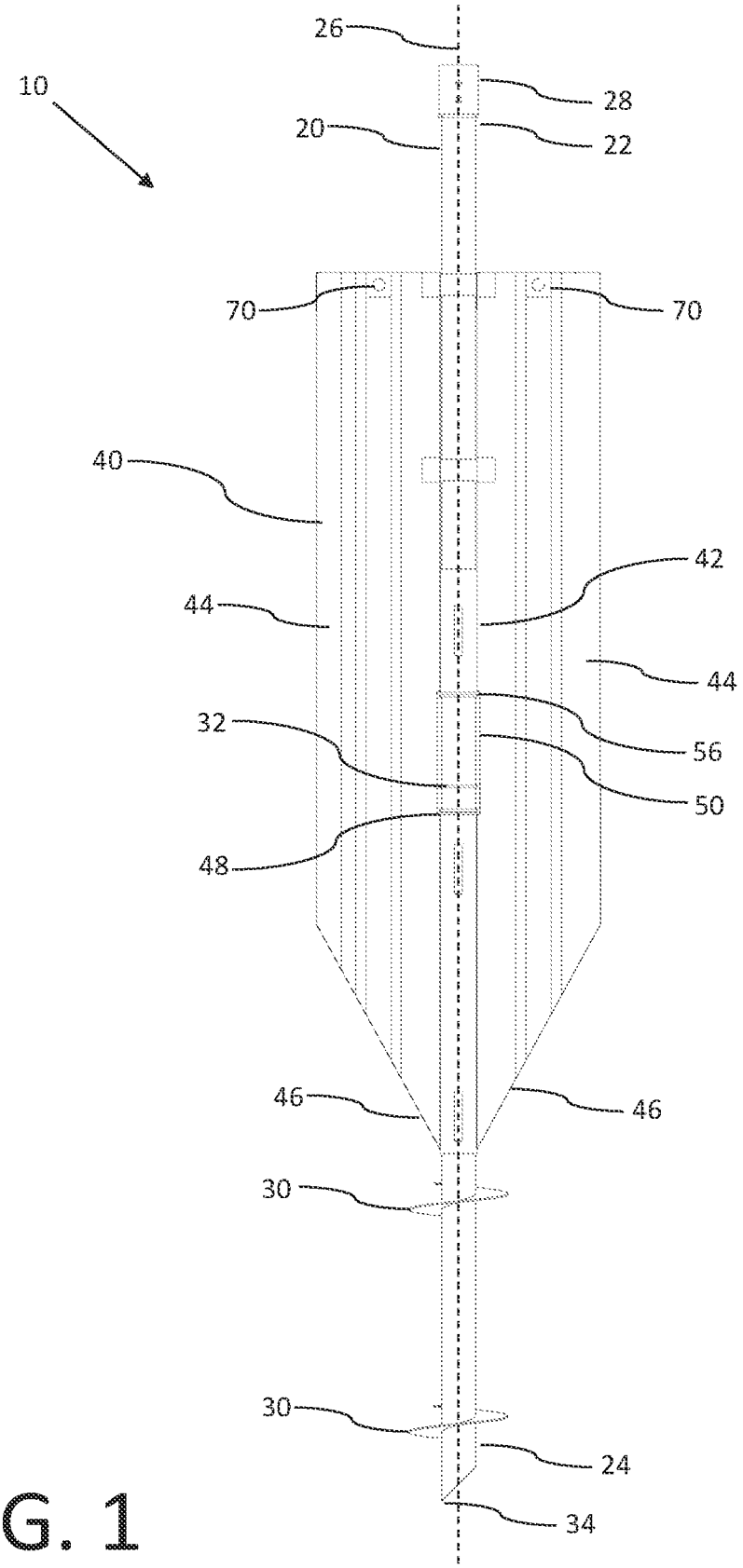
FIG. 1 is a side elevation view of a shoring element.

Referring to FIG. 1, shoring element 10 has a shaft 20 and a shoring plate 40 that is carried on shaft 20. Shaft 20 has a top end 22 and a bottom end 24 and an axis 26. A rotary drive connector 28 is located at top end 22 and an auger 30 is located at bottom end 24. When a driving force is applied to rotary drive connector 28, shaft 20 and auger 30 rotate about axis 26. A drive collar 32 is positioned on shaft 20 between top end 22 and bottom end 24. Rotary drive connector 28 may be located at or near the termination of top end 22 to accommodate the driver that will be used to drive shaft 20. Auger 30 may be a single flight as shown, or two or more flights, and may include a point that extends down from the bottom of the flight that engages the ground before the flight to enhance penetration into the ground formation.

Figure 5:
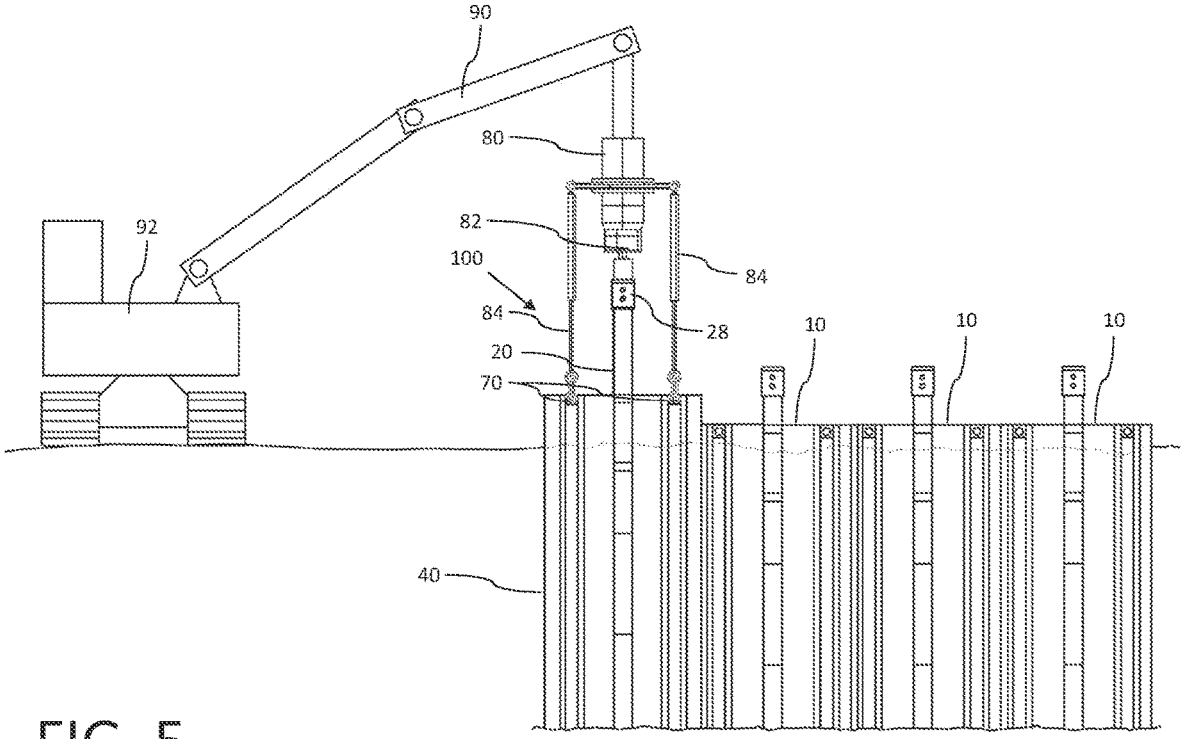
FIG. 5 is a schematic view of an extended arm removing a shoring element.

Shoring plate 40 is mounted to shaft 20 via a shaft receiver 42 that permits shoring plate 40 to rotate and move axially relative to shaft 20. As shown, shaft receiver 42 may be one or more sections of tubing connected between plate sections 44. Shoring plate may have a tapered section 46 designed to be driven into the ground formation. Referring to FIG. 5, when installed to support a ground formation with different heights, shoring plate 40 is intended to have a portion that extends below the lower ground level to act as an anchor and lateral support for shoring element 10, with the remainder extending up from the ground surface to support the higher ground level.

Figure 2:
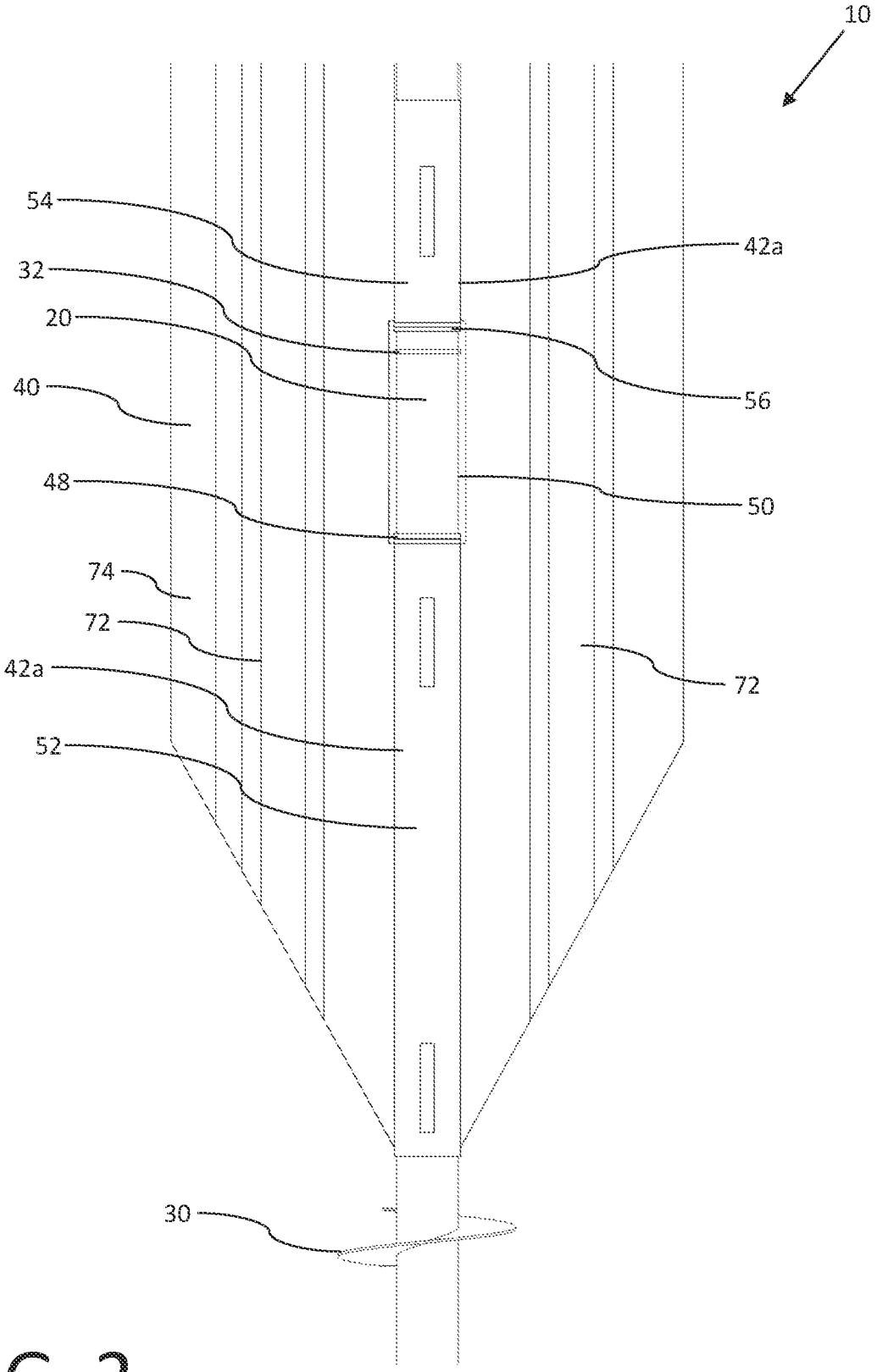
FIG. 2 is a detailed side elevation view of the collars of a shoring element.

Referring to FIG. 2, shaft receiver 42 may include a lower shaft receiver 42*a* that form a first contact point in the form of a drive shoulder 48. When shaft 20 is received within shaft receiver 42, as shaft 20 is rotated and driven into the ground, drive collar 32 engages drive shoulder 48 such that shoring plate 40 is driven into the ground with shaft 20.

As shown, shaft receiver 42 and shoring plate 40 define a space 50 above drive shoulder 48 and around shaft 20 that permits drive collar 32 to move axially relative to shoring plate 40, with the lower limit being defined by drive shoulder 48. Shaft receiver may include an upper shaft receiver 42*b* with a second contact point in the form of an upper shoulder 56 that acts as an upper limit for drive collar 32. In this manner, drive collar 32 and shaft receiver 42 cooperate to permit axial movement of shoring plate 40 along shaft 20 as defined by drive shoulder 48 and upper shoulder 56. In the depicted example, shaft receiver 42 is form from a tubular sleeve, such as a metal pipe, where drive shoulder 48 and upper shoulder 56 are the upper and lower surfaces of sections of pipe 42*a* and 42*b*, respectively, that define shaft receiver 42. This allows the surfaces that are engaged by drive collar 32 to be stronger than the plate material used to form shoring plate 40. In this way, shoring plate 40 may be designed to be strong enough to be driven into and support a ground surface, while shaft receiver 42 is sufficiently strong to bear the driving force applied by drive collar 32. Upper shaft receiver 42*b* and upper shoulder 56 may not experience the same load as lower shaft receiver 42*a* and drive shoulder 48 as upper shoulder 56 acts primarily as a stop on shaft 20 as it moves upward during removal, or to prevent shoring plate 40 to slide downward as shoring element 10 is lifted during transport or installation.

Figure 6:
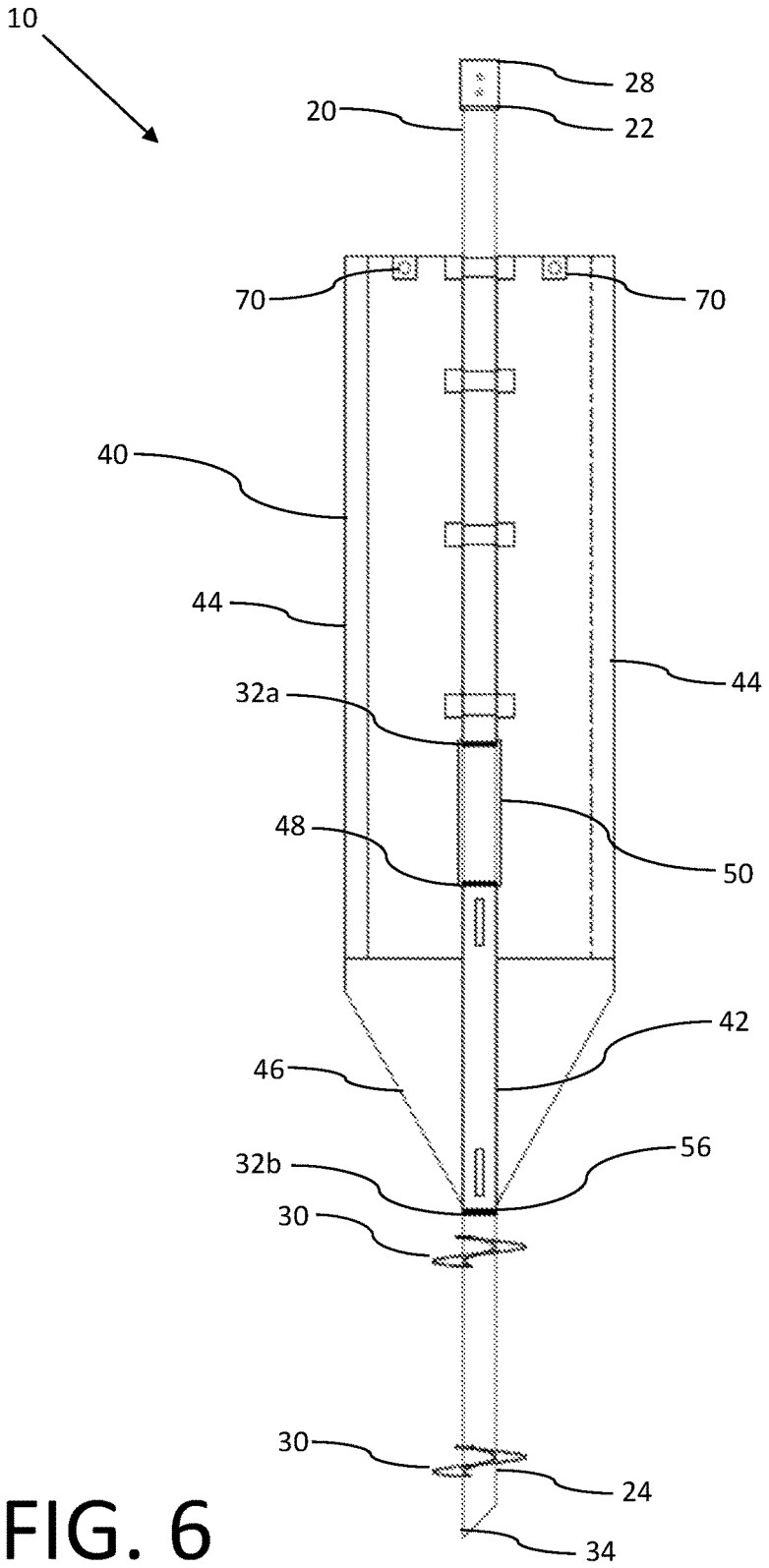
FIG. 6 is a side elevation view of an alternative shoring element.

Referring to FIG. 6, the position of drive shoulder 48 and upper shoulder 56 may vary, and more than one drive collar 32 may be used. For example, drive shoulder 48 may be toward the top of shoring plate 40 relative to upper limit shoulder 56, which is toward the bottom of shoring plate 40. In this example, upper limit shoulder 56 defines the upper limit of shaft 20 relative to shoring plate 40, while drive shoulder 48 defines the lower limit of shaft 20 relative to shoring plate 40. In this example, there is more than one drive collar 32 carried by shaft 20; a first drive collar 32*a* that engages drive shoulder 48 and a second drive collar 32*b* that engages upper shoulder 56. Shoring plate 40 and shaft 20 may be designed to provide at least 12 inches of movement and may be designed to provide up to 24 inches, or 36 inches. Auger 30 may also act as a limit to the upper position of shaft 20, however it may be preferable to mount a collar to bear the load and prevent unnecessary damage to auger 30. In addition, as upper shoulder 56 may be used as a drive shoulder when removing shoring element 10, where upper shoulder 56 is engaged by a drive collar to apply an upward force to shoring plate 40 Similarly, shoring plate 40 may act as drive shoulder 56 and upper shoulder 56, however a stronger material or element may be preferred to prevent damage.

Referring to FIG. 1, shoring plate 40 has lifting points 70 that are designed to allow shoring plate 40 to be supported separately from shaft 20. As shown, lifting points 70 may be apertures formed toward the top of shoring plate 40 and equidistant from shaft 20. During removal of shoring element 10 from the ground formation, rotating shaft 20 in a second direction causes auger 30 to withdraw from the ground formation and drive collar 32 to move away from drive shoulder 48. With drive collar 32 spaced from drive shoulder 48, an upward force may be applied to lifting points 70 to cause shoring plate 40 to move relative to shaft 20, such that limited, independent movement of shaft 20 and shoring plate 40 is permitted during removal. Similarly, with drive collar 32 spaced from upper shoulder 56, shaft 20 may be moved relative to shoring plate 40.

Figure 3:
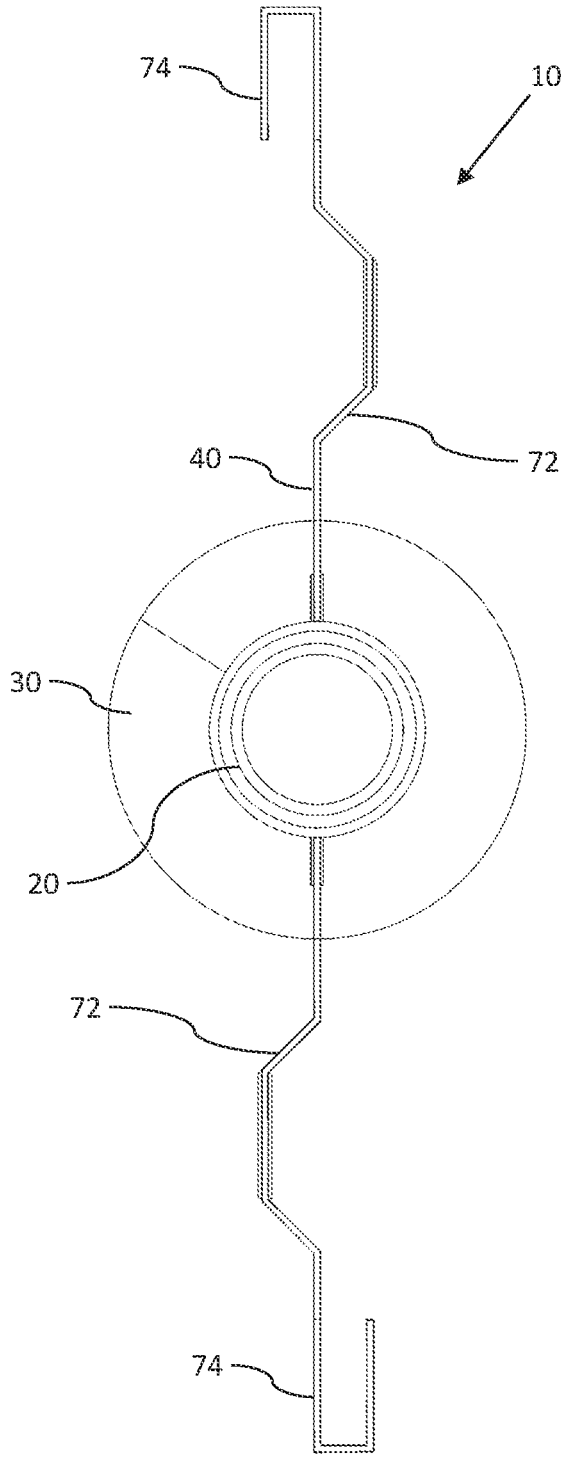
FIG. 3 is a to plan view of the shoring element.

Referring to FIG. 3, shoring plate 40 may have corrugations 72 or other structural elements that strengthen shoring plate 40 against deflection due to forces applied perpendicular to axis 26. As shown, corrugations 72 extend parallel to axis 26, however other direction or patterns may be used. Shoring plate 40 may also have interconnections 74 along the side edges that allow for the connection of one shoring element 10 to an adjacent shoring element 10. As shown, interconnections 74 are u-shaped profiles on the edges of shoring plates 40 that interlock with adjacent plates 40 to form a retaining wall. Other types of profiles or interconnects may also be used.

Figure 4A:
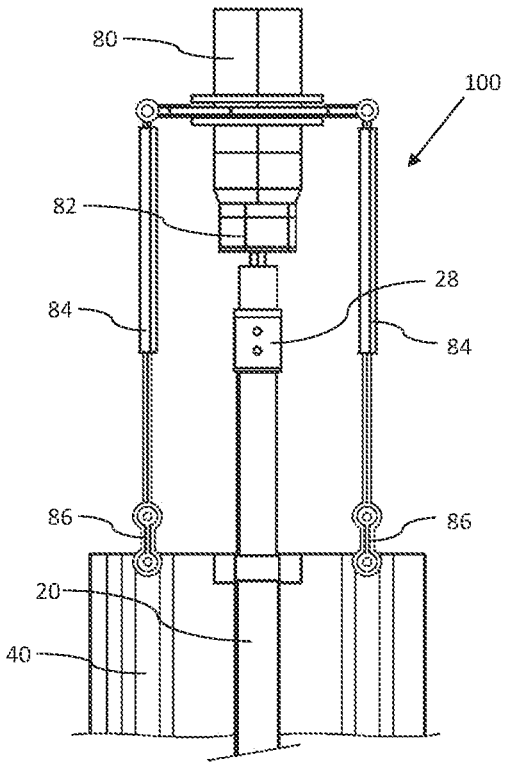
FIG. 4*a* is a detailed side elevation view of a lifting device connected to the shoring element with the shoring plate in a lower position on the shaft.
Figure 4B:
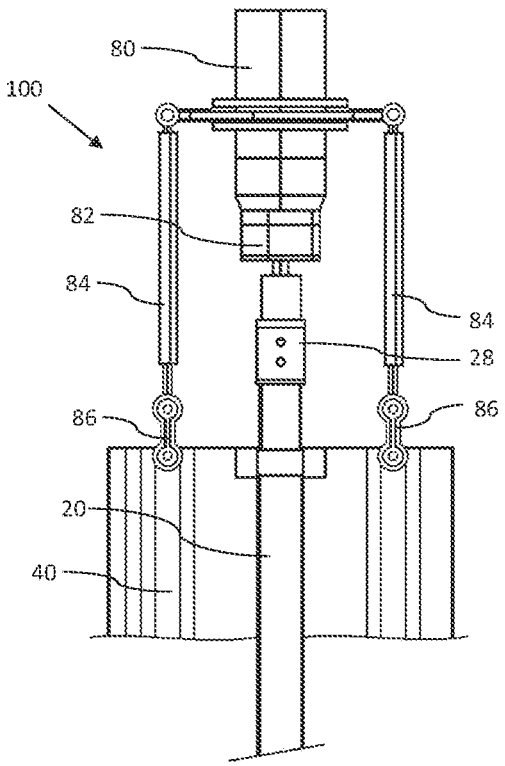
FIG. 4*b* is a detailed side elevation view of a lifting device connected to the shoring element with the shoring plate in a lower position on the shaft.

Referring to FIG. 4*a* and FIG. 4*b* a system 100 for removing shoring elements 10 may include a driver 80, which, referring to FIG. 5, may be carried by a moveable and/or extendable arm 90 such as an arm of a backhoe 92 or other piece of heavy machinery. Referring again to FIG. 4*a*, driver 80 has a rotary driver 82 and lifting elements 84 on opposed sides of rotary driver 82. Rotary driver 82 engages rotary drive connector 28, and may be any connection suitable for driving shaft 20, such as a male-female connection, a pin connection, etc. Lifting elements 84 engage lifting points 70 of shoring plate 40. As shown, lifting elements 84 may be linear actuators, such as hydraulic cylinders, that are anchored relative to rotary driver 82 and have connector ends 86 that extend to connect to lifting points 70. Referring to FIG. 4*b*, lifting elements 84 apply a lifting force to shoring plate 40 relative to shaft 20, and may use connector 28 as a leverage point such that the lifting force is applied between the top end of shaft 20 and shoring plate 40. Referring to FIG. 5, this reduces the load on extendable arm 90, which may otherwise overbalance heavy equipment under certain circumstance. Lifting elements 84 and rotary driver 82 may be powered by hydraulic connections or other power transfer devices (not shown) powered and controlled by heavy equipment 92. Rotary driver 82 and lifting elements 84 may be used to install and remove shoring element 10 into the ground formation. During installation, lifting elements 84 may be disconnected or a different tool (not shown) may be used that does not include lifting elements 84.

Referring to FIG. 5, shoring element 10 is intended to be installed with a bottom portion of shaft 20 and shoring plate 40 inserted in the ground. Referring to FIG. 1, this is accomplished by driving shaft 20, causing auger 30 to rotate, which drives shaft into the ground. As shaft 20 is driven into the ground, drive collar 32 engages drive shoulder 48 and pulls shoring plate 40 into the ground along with shaft 20. To remove shoring element 10, referring to FIG. 5, driver 80 engages shoring element 10 by connecting rotary driver 82 to rotary drive connector 28 and lifting elements 84 to lifting points 70. Rotary driver is actuated to drive shaft 20 in a second rotary direction that causes auger 30 to lift shaft 20 and withdraw it from the ground formation. As shaft 20 is withdrawn from the ground formation, shaft 20 moves away from a first position in which drive collar 32 is engaged with drive shoulder 48 of shoring plate 40 and toward a second position in which shaft 20 is spaced from drive shoulder 48. The second position may be defined by the travel distance permitted relative to shoring plate 40, such as by upper limit shoulder 56. While shaft 20 moves from the first position, shoring plate 40 remains substantially stationary. As rotary driver 82 will typically move with shaft 20, lifting elements 84 may extend as shaft 20 is withdrawn from the ground surface, as illustrated in FIG. 4*a*. If upper limit shoulder 56 is present, further rotation of shaft 20 may cause shoring plate 40 to withdraw with shaft 20 as drive collar 32 an upward force is applied. However, if plate 40 is stuck, further rotation may cause damage to shoring element 10 or may cause auger 30 to become jammed with dirt such that further rotation is ineffective. In such a case, or if upper shoulder 56 is not load bearing, once shaft 20 has been withdrawn a certain distance, a lifting force may be applied to lifting points 70 of shoring plate 40 to such that shoring plate 40 withdraws from the ground formation. The lifting force is applied by lifting elements 84 and may use the engagement between rotary driver 82 and drive connector 28 as a support surface such that shoring plate 40 is able to be lifted relative to shaft 20, as shown in FIG. 4*b*. The steps of alternatingly withdrawing shaft 20 and shoring plate 40 may be repeated until shoring element 10 is able to be withdrawn from the ground formation, where the maximum amount of relative movement may be defined by the position of drive shoulder 48 and upper limit shoulder 56.

Referring to FIG. 5, by applying the lifting force between shoring plate 40 and shaft 20 rather than by excavator 92, excavator 92 is only required to bear the weight of shoring element 10 after it is withdrawn from the ground surface. As access to shoring elements 10 may be limited, excavator 92 may be required to extend across a greater distance to reach shoring element 10 and applying the lifting force using shaft 20 as the support surface may give excavator 92 greater access to shoring elements 10.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context requires that there be one and only one of the elements.

The scope of the following claims should not be limited by the preferred embodiments set forth in the examples above and in the drawings but should be given the broadest interpretation consistent with the description as a whole.

What is claimed is:

1. A shoring element, comprising:

a shaft having a top end, a bottom end, and an axis, the shaft comprising a rotary drive connector at the top end of the shaft, an auger at the bottom end of the shaft, and a drive collar axially spaced between the top end and the bottom end, the auger having a pitch;

a shoring plate comprising:

a shaft receiver that receives the shaft such that the shoring plate is rotatably and axially moveable relative to the shaft;

a drive shoulder that is sized to engage the drive collar, the drive shoulder being positioned between the drive collar and the bottom end of the shaft, wherein the shoring plate is movable along the shaft between an engaged position in which the drive shoulder is engaged with the drive collar, and a spaced position in which the drive shoulder is spaced from the drive collar toward the bottom end of the shaft by a travel distance, wherein the travel distance is greater than twice the pitch of the auger; and lifting points;

wherein the shaft and the shoring plate are provided such that:

during installation, rotating the shaft in a first direction causes the auger to drive the shaft into a ground formation and the drive collar to contact the drive shoulder of the shoring plate such that the drive collar applies a driving force to the shoring plate; and during removal:

with the shoring plate stationary, rotating the shaft through a plurality of rotations in a second direction causes the auger to withdraw from the ground formation relative to the shoring plate and move along the travel distance from the engaged position toward the spaced position, and with the shaft stationary, applying an upward force to the lifting points causes the shoring plate to move along the travel distance toward the top end of the shaft from the spaced position toward the engaged position.

2. The shoring element of claim 1, wherein the upward force is applied between the lifting points and the top end of the shaft.

3. The shoring element of claim 1, wherein the shaft receiver is a first tubular sleeve, and the drive shoulder is a top surface of the first tubular sleeve.

4. The shoring element of claim 3, wherein the shaft receiver further comprises a second tubular sleeve spaced from the first tubular sleeve toward the top end of the shaft, a bottom surface of the second tubular sleeve comprising an upper limit shoulder, and the drive collar being disposed between drive shoulder and the upper limit shoulder.

5. The shoring element of claim 1, wherein the shoring plate further comprises an upper limit shoulder that is positioned between the drive collar and the top end of the shaft such that the axial movement of the shoring plate along the shaft is limited by the drive shoulder and the upper limit shoulder.

6. The shoring element of claim 5, wherein the shaft receiver is a tubular sleeve, the drive shoulder is a bottom surface of the tubular sleeve, and the upper limit shoulder is a top surface of the tubular sleeve, and wherein the drive collar comprises a first drive collar that is adapted to engage the drive shoulder and a second drive collar that is adapted to engage the upper limit shoulder, wherein a spacing between the first drive collar and the second drive collar defining the axial movement of the shoring plate along the shaft.

7. The shoring element of claim 1, wherein the lifting points comprise apertures formed in the shoring plate.

8. A method of removing a shoring element, comprising:

with the shoring element installed in a ground formation, the shoring element comprising a shaft and a shoring plate, the shaft comprising a rotary drive connector at a top end of the shaft, an auger at a bottom end of the shaft, and a drive collar spaced between the rotary drive connector and the auger that engages a drive shoulder of the shoring plate, the shaft being carried in a shaft receiver of the shoring plate that permits limited axial movement of the shaft relative to the shoring plate:

using a rotary drive configured to apply a rotary force to the rotary drive connector, driving the rotary drive connector in a direction that causes the auger to withdraw from the ground formation such that the shaft moves axially relative to the shoring plate and the drive collar is spaced from the drive shoulder of the shoring plate; and with the shaft stationary, using a linear actuator to apply a lifting force to the shoring plate relative to the shaft such that the shoring plate moves axially relative to the shaft and the drive shoulder moves toward the drive collar.

9. The method of claim 8, further comprising alternatingly repeating the steps of driving the rotary drive connector and applying a lifting force to the shoring plate.

10. The method of claim 8, wherein lifting force is applied between the top end of the shaft and lifting points of the shoring plate.

11. The method of claim 8, wherein the shoring plate further comprises an upper limit shoulder that is positioned between the drive collar and the top end of the shaft such that the axial movement of the shoring plate along the shaft is limited by the drive shoulder and the upper limit shoulder.

12. The method claim 8, wherein the drive collar and the shaft receiver permit at least 12 inches of axial movement of the shoring plate along the shaft.

13. A system for removing shoring plates from a ground formation, the system comprising:

a shoring element comprising:

a shaft having a top end, a bottom end, and an axis, the shaft comprising a rotary drive connector at the top end of the shaft, an auger at the bottom end of the shaft, and a drive collar axially spaced between the top end and the bottom end;

a shoring plate comprising:

a shaft receiver that receives the shaft such that the shoring plate is rotatably and axially moveable relative to the shaft, the drive collar and the shaft receiver cooperating to permit limited axial movement of the shoring plate along the shaft toward the top end of the shaft;

a drive shoulder that is sized to engage the drive collar, the drive shoulder being positioned between the drive collar and the bottom end of the shaft; and lifting points;

a driver comprising:

a rotary driver that is configured to apply a rotary force to the rotary drive connector; and linear actuators on opposed sides of the rotary driver that are configured to engage the lifting points of the shoring plate and apply a lifting force relative to the rotary driver, such that the lifting force is applied between the top end of the shaft and the lifting points;

wherein:

during installation, the rotary driver rotates the shaft in a first direction to cause the auger to drive the shaft into a ground formation and the drive collar to contact the drive shoulder of the shoring plate such that the drive collar applies a driving force to the shoring plate; and during removal, the rotary drive rotates the shaft in a second direction to cause the auger to withdraw from the ground formation and the drive collar to move away from the drive shoulder, and the linear actuators apply an upward force to the lifting points to cause the shoring plate to move toward the top end of the shaft.

14. The system of claim 13, wherein the linear actuators comprise hydraulic cylinders.

15. The system of claim 13, wherein the shaft receiver is a first tubular sleeve, and the drive shoulder is a top surface of the first tubular sleeve.

16. The system of claim 15, wherein the shaft receiver further comprises a second tubular sleeve spaced from the first tubular sleeve toward the top end of the shaft, a bottom surface of the second tubular sleeve comprising an upper limit shoulder, and the drive collar being disposed between drive shoulder and the upper limit shoulder.

17. The system of claim 13, wherein the shaft receiver comprises a first tubular sleeve having a top surface that comprises the drive shoulder and a second tubular sleeve spaced from the first tubular sleeve toward the top end of the shaft, the second tubular sleeve having a bottom surface that comprises an upper limit shoulder.

18. The system of claim 13, wherein the shoring plate further comprises an upper limit shoulder that is positioned between the drive collar and the top end of the shaft such that the axial movement of the shoring plate along the shaft is limited by the drive shoulder and the upper limit shoulder.

19. The system of claim 13, wherein the drive collar and the shaft receiver permit at least 12 inches of axial movement of the shoring plate along the shaft.

20. A shoring element, comprising:

a shaft having a top end, a bottom end, and an axis, the shaft comprising a rotary drive connector at the top end of the shaft, an auger at the bottom end of the shaft, and a drive collar axially spaced between the top end and the bottom end;

a shoring plate comprising:

a shaft receiver that receives the shaft such that the shoring plate is rotatably and axially moveable relative to the shaft, the drive collar and the shaft receiver cooperating to permit limited axial movement of the shoring plate along the shaft toward the top end of the shaft;

a drive shoulder that is sized to engage the drive collar, the drive shoulder being positioned between the drive collar and the bottom end of the shaft; and lifting points;

wherein:

during installation, rotating the shaft in a first direction causes the auger to drive the shaft into a ground formation and the drive collar to contact the drive shoulder of the shoring plate such that the drive collar applies a driving force to the shoring plate;

during removal, rotating the shaft in a second direction causes the auger to withdraw from the ground formation and the drive collar to move away from the drive shoulder, and applying an upward force to the lifting points causes the shoring plate to move toward the top end of the shaft; and the drive collar and the shaft receiver permit at least 12 inches of axial movement of the shoring plate along the shaft.

* * * * *